US007515686B2

(12) United States Patent
Kirk

(10) Patent No.: US 7,515,686 B2
(45) Date of Patent: Apr. 7, 2009

(54) IRRADIATION METHOD AND APPARATUS

(76) Inventor: Randol E. Kirk, 1517 Bryn Mawr Dr., Albuquerque, NM (US) 87106

( * ) Notice: Subject to any disclaimer, the term of this patent is extended or adjusted under 35 U.S.C. 154(b) by 20 days.

(21) Appl. No.: 11/800,394

(22) Filed: May 5, 2007

(65) Prior Publication Data

US 2008/0273661 A1 Nov. 6, 2008

(51) Int. Cl.
*G21K 5/10* (2006.01)

(52) U.S. Cl. ..... 378/69; 378/57

(58) Field of Classification Search ..... 378/57, 378/64, 68, 69; 250/454.11; 426/240
See application file for complete search history.

(56) References Cited

U.S. PATENT DOCUMENTS 3,506,825 A * 4/1970 Hartmann ..... 378/69
4,029,967 A * 6/1977 Tetzlaff ..... 378/69
5,001,352 A * 3/1991 Tetzlaff ..... 250/453.11
5,504,799 A * 4/1996 Suzuki ..... 378/136
5,577,090 A * 11/1996 Moses ..... 378/64

* cited by examiner

*Primary Examiner*—Edward J Glick
*Assistant Examiner*—Mona M Sanei
(74) *Attorney, Agent, or Firm*—Leo J. Aubel

(57) ABSTRACT

An apparatus and method for providing uniform X-Ray irradiation to material carried in a plurality of containers. The apparatus includes an X-Ray tube providing a linear source of irradiation and also a 4 pi (360 degrees) irradiation. The material to be irradiated is placed in containers suspended on a vertical carousel wheel type structure. The individual containers are mounted receive irradiation throughout the rotation of the wheel. The tube is mounted approximately at the axis or center of the wheel. In operation, the containers of material are rotated around the tube, and due to their orientation and the 4 pi irradiation from the source, each and all the containers receive a uniform irradiation for the material contained therein.

1 Claim, 2 Drawing Sheets

IRRADIATION METHOD AND APPARATUS

BACKGROUND OF INVENTION

The present application is related to U.S. Pat. Nos. 6,212,255 and 6,614,876 issued to Randol E. Kirk, the inventor hereof, which patents are incorporated herein by reference. The present application is also related to U.S. Pat. No. 6,389,099 issued to Gueorgui Guerorguiv titled "Irradiation System and Method Using X-Ray and Gamma-Ray Reflector" and to US Patent Publication 2007/0025515 titled "X-ray Tube With Cylindrical Anode" issued to of Randol E. Kirk and Daniel F. Gorzen. In fact, the present application discloses one specific system wherein the X-ray tube with a cylindrical anode has an extremely beneficial use. US Patent Publication 2007/0025515 is also incorporated herein by reference.

The present invention generally relates to a more efficient apparatus and method for irradiation of material utilizing X-rays. While the invention will be described for use for the sterilization of food products, the invention is also applicable to various fields in which efficient irradiation of material is in demand including industrial and medical sterilization.

The FDA has approved the use of ionization radiation from three different sources of irradiation that produce essentially equivalent pathogen reduction. The three approved sources are gamma rays from radioactive cobalt-60 or cesium-137, linear accelerators producing electron energies less than ten million volts, and X-Rays generated from equipment energies of less than five million volts.

Each of said types of sources are in present use throughout the USA for the sterilization of food products. The present invention utilizes an X-Ray source of irradiation that is believed to have a number of advantages over the other two types of sources that need not be discussed in detail herein. Such other sources are generally much larger in size and scale are much higher in initial cost, and pose higher safety hazards normally requiring more sophisticated irradiation protection.

SUMMARY OF INVENTION

An apparatus and method for providing uniform X-Ray irradiation to material carried in a plurality of containers. The apparatus includes an X-Ray tube providing a linear source of irradiation and also a 4 pi (360 degrees) irradiation. The material to be irradiated is placed in containers suspended on a vertical carousel wheel type structure. The individual containers are mounted to receive irradiation throughout the rotation of the wheel. The tube is mounted approximately at the axis or center of the wheel. In operation, the containers of material are rotated around the tube, and due to their orientation and the 4 pi irradiation from the source, each and all of the containers receive a uniform irradiation for the material contained therein.

The foregoing features and advantages of the present invention will be apparent from the following more particular description of the invention. The accompanying drawings, listed herein below, are useful in explaining the invention.

DRAWINGS

DESCRIPTION OF THE INVENTION

Figure 1:
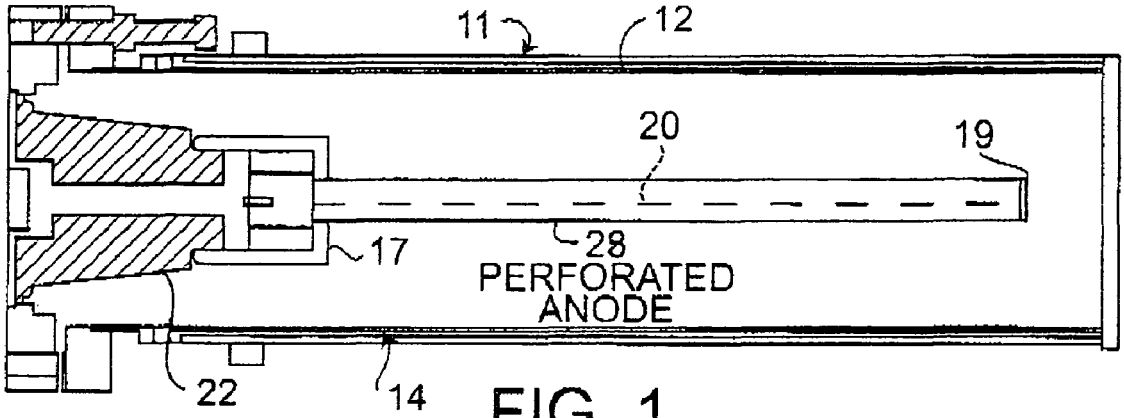
FIG. 1 is a view of the X-Ray tube to show its elongated body.

Refer first to FIG. 1 that shows a side view of the linear source of irradiation comprising X-Ray tube 11. This linear source of irradiation is the subject matter of the above cited publication number 2007/0025515 which publication is adopted herein by reference. X-ray tube 11 has a cylindrical housing 12 and includes an elongated filament 20 mounted within a perforated cylindrical and tubular anode 28. In the embodiment of the X-ray tube 11 in FIG. 1, the length of the tube is 17.2 inches in length and 4.5 inches in diameter. Power to the tube is provided through a high voltage connector 22. Tube 11 provides a linear, rather than a point source, of irradiation and a 4 pi/360 degree emission. The tube is cooled by means of a water jacket 14 encircling the housing 12.

Tube 11 provides a 4 pi/360 degree emission utilizing basic concepts disclosed in the above cited references. In addition to the concepts of a linear anode disclosed in US publication 2007/0025515, reference is also made to U.S. Pat. No. 6,389,099 which discloses the concept of a radiation reflector. Reference is also made to U.S. Pat. No. 6,614,876 which discloses the concept of combining the radiation energy from multiple sources to irradiate a product as well as the concept of utilizing reflected photon energy from various surfaces to add to or combine with the direct radiation energy to provide enhanced irradiation. The linear tube 11 is a basic component of the method and apparatus of the invention, as will become clear.

Figure 5:
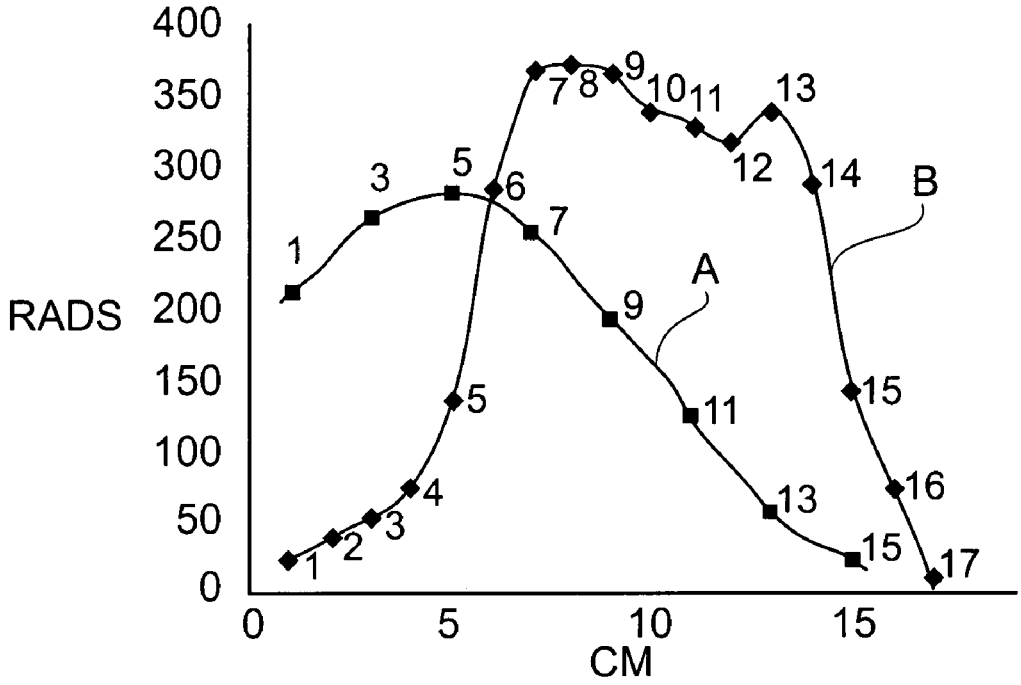
FIG. 5 is a graph showing the uniform source of irradiation provided to the containers in accordance with the invention.

The graph of FIG. 5 depicting rads output on its vertical axis of abscissa and length in centimeters on it horizontal axis of ordinates. The two plots in FIG. 5, line A and line B, depict the output of the X-ray tube 11 of FIG. 1 for two modifications of the X-ray tube to measure the dose peak and uniformity of output of the tube. Referring still to FIG. 1, it has been found empirically that the dose peak and uniformity are dependent on at least three factors; the size and shape of the face of support 17 holding the filament 20, the diameter of the perforated anode 28, and the size and shape of the cap piece 19 on the distal end of the filament. It appears that the diameter and size of all three of the cited components contribute to shape the electron output of the tube and determine the field effect.

Figure 2:
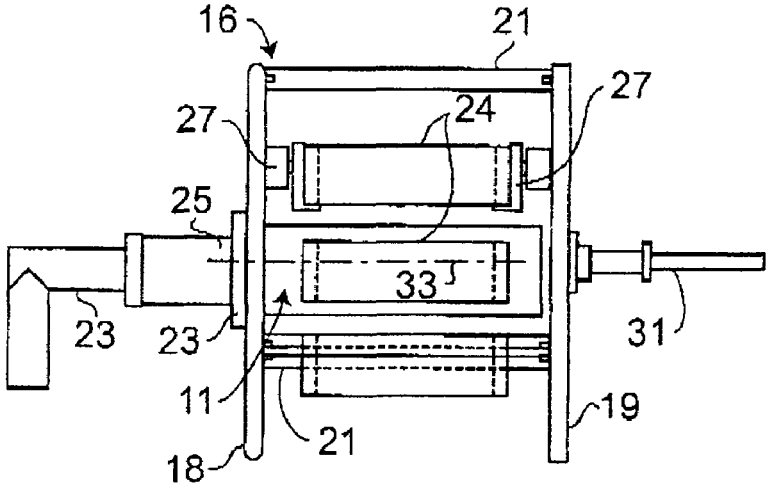
FIG. 2 is an isometric view of the X-Ray tube and the material holding containers positioned in the vertical carousel structure.
Figure 3:
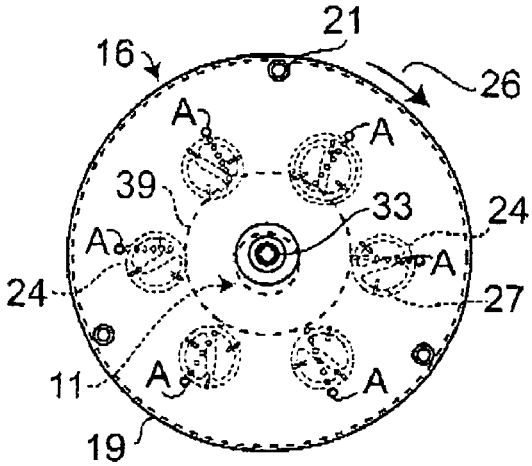
FIG. 3 is a front view of the vertical carousel wheel structure.
Figure 4:
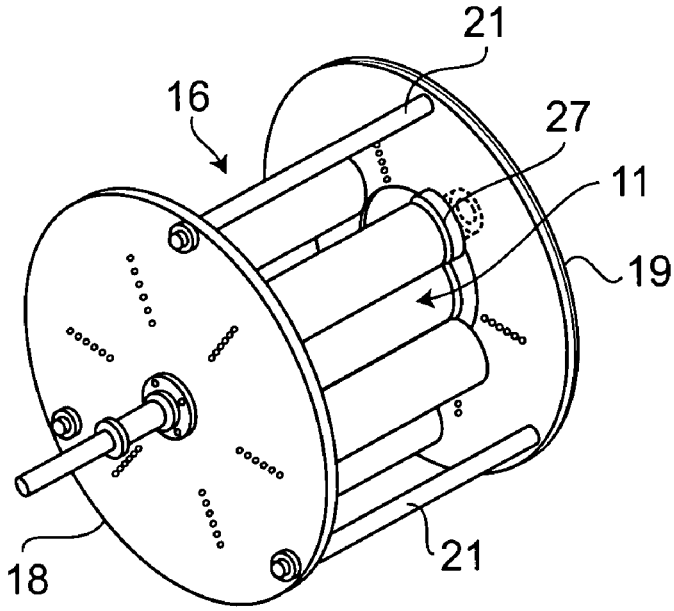
FIG. 4 is a side view of the wheel structure and the unique mounting or positioning of the X-Ray tube.

FIGS. 2, 3 and 4 show the configuration of the inventive apparatus that comprises a rotatable mechanism for carrying product which is to be irradiated by the X-Ray tube 11. Basically, the mechanism consists of a Ferris wheel type structure or system 16 having two spaced wheels 18 and 19 affixed to one another by braces or rods, generally labeled 21. The product to be irradiated is set or placed in containers 24. The embodiment of system 16 shown herein has six cylindrical containers. Each container is mounted on a respective cradle assembly 27. The cradle assemblies 27 are mounted in a spaced pattern between the wheels 18 and 19 and along the periphery of the wheels, as clearly shown in the FIGS. 2, 3 and 4.

The mounting of the cradle assemblies 27 is similar to that of a well known Ferris wheel; that is, each cradle 27 is swingably (the cradle can move back and forth as a swing about a mounting pivot pin) mounted on a horizontally extending axle (hung similarly to a Ferris wheel seat) so that the cradle center of gravity causes the cradle to maintain the similar orientation throughout its circular path around the periphery of the system. The cradle assemblies 27 are shaped to receive containers 24, which may be cylindrical in shape. The containers 24 carry (contain) the product or goods to be irradiated.

Refer now to FIG. 1, as well as to FIGS. 2 and 3. The X-ray tube 11 (tube housing 12) is mounted in a stationary position at the approximate center of the wheel structure 16 by a mechanical wheel and axle drive 23 to enable the wheel structure 16 to rotate about the tube housing 12 mount. The passive mounting or distal end of the axle 31 mounts wheel 19 to a suitable support, see FIG. 2. As can be appreciated, the axle 23 drives the wheel 18 which in turn is connected through rods 21 to move wheel 19 which is mounted on passive axle 31. High voltage power to the high voltage connector 22 of tube 11 is connected through through known types of cables and insulating connectors generally indicated at 25.

Note now a unique feature of the structure of mechanism 16. As best seen in FIGS. 2 and 3, the cylindrically shaped X-Ray tube 11 is mounted slightly off center of the wheel axis, indicated by dashed line 33 in FIG. 2. The orientation of FIGS. 2 and 3 shows the tube 11 which is axially mounted in its housing 12 to be off centered below the axis 33. The purpose for this construction will be explained herein below.

In operation, product is placed inside the containers 24. The product in containers 24 receives the radiation energy from tube 11 and is set or placed in the container and should not tumble or revolve within the container 24 when the cradle 27 and wheels 18 and 19 rotate the container. Recall the similarity to a Ferris wheel wherein a person sits in the seat in an upright position, and even though the person is rotated on and by the wheel the seat assembly enables the person to remain in an upright position. Similarly in the present structure, the container 24 is rotated by the wheels and is structured to retain its initial orientation to also retain the product in its initial orientation and position.

However, because the container 24 is mounted to retain it's initial orientation the container seat does not move in an exact circle. The seat wobbles in its rotation, and is closer to the axis 33 of the wheel when it is above the axis and further from the axis when it is below the axis. In FIGS. 2 and 3, note the axis labeled 33 and the imaginary dotted circle labeled 39 about the axis 33. By reference to circle 39 it can be seen that the cradles 27 carrying the containers 24 rotate in a wobbling manner about circle 39.

A well known principle in X-ray technology is that radiation energy is related to the distance between the X-ray source and the product receiving the energy. (Assume for purposes of the following explanation that FIG. 3 represents a clock face). In the inventive structure 16, the side (say bottom side) of each of the containers 24 is closest to the tube 11 when the container is at its highest position (12 o'clock position) and receives the most radiation energy from the tube. In contrast, the other side (say top side) of each container receives the least radiation when the container is at its lowest position (6 o'clock position). This action would continue throughout each cycle for each of the containers.

As alluded to above and as will be described further, the present invention provides an apparatus to assure that a more uniform irradiation is provided to all of the product in each container. Refer now mainly to FIG. 3. In operation, as the carousel 16 is rotated, the containers 24 are moved about the axis of rotation 33. As the cylinders 24 are moved around axis 33 the side of each of the containers 24 facing the tube 11 changes. Note in FIG. 3, an imaginary dot "A" painted on the container 24 (for present explanation purposes) at the one o'clock position points upwardly to the right. As the container 24 is rotated clockwise by the wheels, to the three o'clock position, the dot "A" points to the right; at the five o'clock position, the dot "A" points downwardly to the right. As the container continues to rotate, to the 11 o'clock position the imaginary dot "A" is rotated almost back to its initial position. Note, of course that there are six containers 24, all of which are moving concurrently and that the above explanation is applicable to each container as it moves about its circle.

In FIG. 3, the axis of the wheels is labeled as 33; the stationary position of the X-ray tube 11 is indicated by imaginary dotted line circle 11, and wheels 18 and 19 move around the tube. If the tube were to be mounted on the axis 33 of the wheels, the distance between the tube 11 and each of the containers 24 would vary as the containers move around the tube. This is clearly indicated by the overlapping of the dotted line 39 by containers at the one o'clock position and at the eleven o'clock position. If the tube 11 were mounted along the axis of the wheel, a higher amount of radiation energy would impinge on one side of the container 24, mounted at the relative axis of the wheels simply because it is closer to the tube at that position.

The inventor has found that a more uniform irradiation from the X-Ray tube 11 to the product in each of the containers 24 is obtained by mounting the tube 11 in a position that is offset from the axis of the wheels 18 and 19, as clearly shown in FIG. 2. This feature is also indicated in FIG. 3 by the dotted circle labeled 11, that depicts the relative position of the tube. The distance that the containers 24 moved downwardly relative to the circle 39 can be calculated, or the axis 33 can be empirically determined. The tube is mounted in position, and offset downwardly from the axis 33 to compensate for the amount of variation in the relative position of a container in the twelve o'clock position and a container in the six o'clock position. The purpose, of course, is an attempt to maintain the distance of the containers from the X-Ray tube 11 relatively constant as each container is moved on by its cradle affixed to wheels 18 and 19.

While the invention has been particularly shown and described with reference to preferred embodiments thereof, it will be understood by those skilled in the art that various changes in form and details may be made therein without departing from the spirit and scope of the invention.

The invention claimed is:

1. Apparatus for providing X-ray energy to irradiate a product comprising:

a) an elongated X-ray tube providing X-ray energy;

b) a wheel structure having a defined axis of rotation being mounted to rotate about said X-ray tube;

c) a plurality of containers for receiving the product to be irradiated mounted equidistant from said axis and in spaced relation to each other on said wheel structure;

d) cradles for said containers being mounted to said wheel structure by mounting elements be swingable and have free rotation about the mounting elements with said mounting elements being offset from the center of said cradles thereby allowing said cradles to utilize gravity to maintain an initial horizontal orientation as said cradles are moved in a circle around said X-ray tube by said wheel structure; and e) said elongated X-ray tube being mounted in relatively an offset axial position with reference to the axis of rotation of said wheel structure;

f) said tube as mounted, allowing the distance between said tube and said containers to remain relatively uniform throughout the rotation of said containers, whereby as the wheel structure is rotated, the energy provided by said X-ray tube uniformly irradiates the product contained in each of said containers.

* * * * *